US005651410A

United States Patent [19]

Perry et al.

[11] Patent Number: 5,651,410

[45] Date of Patent: Jul. 29, 1997

[54] COOLING ROLL

[75] Inventors: Robert Maidens Perry, Whitehaven; Barry Graham Corlett, Workington; Timothy Reynolds, Cockermouth; David Alan Preshaw, Workington; Edward Alexander Winder, Cockermouth, all of Great Britain; Young Kil Shin; Taewook Kang, both of Pohang, Rep. of Korea

[73] Assignee: Davy McKee (Sheffield) Limited, Sheffield, United Kingdom

[21] Appl. No.: 674,085

[22] Filed: Jul. 1, 1996

Related U.S. Application Data

[63] Continuation of Ser. No. 87,727, Jan. 12, 1995, abandoned.

[30] Foreign Application Priority Data

Jan. 4, 1991 [GB] United Kingdom ..... 9100151

[51] Int. Cl.[6] ..... B62D 11/06

[52] U.S. Cl. ..... 164/428; 164/429; 492/46

[58] Field of Search ..... 164/448, 428, 164/429, 443, 480, 479, 485, 442; 492/20, 45, 46; 29/895.212; 165/89

[56] References Cited

U.S. PATENT DOCUMENTS

| | | | |
|---|---|---|---|
| 3,757,847 | 9/1973 | Sofinsky et al. | 164/428 |
| 4,442,883 | 4/1984 | Yamakami et al. | 164/448 |
| 5,152,333 | 10/1992 | Barbe et al. | 164/448 X |

FOREIGN PATENT DOCUMENTS

| | | |
|---|---|---|
| 1-245947 | 10/1989 | Japan . |
| 5-253648 | 10/1993 | Japan . |
| 6-182499 | 7/1994 | Japan . |

*Primary Examiner*—J. Reed Batten, Jr.

*Attorney, Agent, or Firm*—Lee, Mann, Smith, McWilliams, Sweeney & Ohlson

[57] ABSTRACT

The roll comprises a rotatable arbor (1) with an annular sleeve (7) shrunk onto it. There are internal passages (25) in the sleeve for the flow of liquid coolant there along. The internal passages are in communication with ducts (19, 21) in the arbor and the liquid coolant passed along the passages from the ducts forms a thermal barrier in the sleeve between the outer periphery and the interface.

5 Claims, 2 Drawing Sheets

COOLING ROLL

This application is a continuation of application Ser. No. 087,727, filed Jan. 12, 1995 and now abandoned which is a 371 of PCT/GB92/00008 filed Jan. 3, 1992.

BACKGROUND OF THE INVENTION

This invention relates to a roll suitable for transferring heat between the roll and the material in contact with it. A particular, but not sole, application of the invention is to a roil suitable for use in a two-roll strip caster.

A strip caster usually consists of a pair of rolls, arranged side-by-side with their axes of rotation horizontal, and which are spaced apart to provide a gap between them. On the upper side of the rolls, the ends of the roll barrels can be provided with dams to form a space above the roll gap into which molten metal is poured. The rolls are usually liquid cooled to absorb heat from the molten metal which come into contact with them and form solidified skins which thicken as the rolls rotate. As the rolls are rotated they force the solidified skins of metal together and through the gap between the rolls to form a continuous metal strip.

In an effort to increase casting output, it is desirable to increase the speed of rotation of the rolls, but care has to be taken that the rolls absorb sufficient heat from the metal in contact with them to form two solidified skins whose total thickness is greater than the end product.

U.S. Pat. No. 4,019,846 discloses a roll employed in a briquetting machine. The roll comprises an arbor with an annular sleeve mounted on the arbor. There are axially extending passageways for cooling liquid in the sleeve and manifold ring assemblies mounted externally of the roll enable the cooling liquid to be supplied to the passageways. Two rings mounted externally of the roll are connected to opposite sides of the arbor and sleeve thereby preventing relative movement between them.

DE-A-3839110 discloses a roll for a twin-roll continuous caster. The roll comprises an arbor on the circumference of which are first and second sleeves. The first sleeve is a shrink fit on the arbor and the second sleeve is a shrink fit on the outer periphery of the first sleeve. Cooling liquid is supplied to the interface between the two sleeves and passes in the axial direction of the roll along the interface.

SUMMARY OF THE INVENTION

An object of the present invention is to provide an improved roll construction which permits greater throughput together with a stable roll design, which can readily be refurbished at the end of its useful life.

According to the present invention a cooling roll comprises a rotatable arbor; an annular sleeve structure mounted on the arbor with a shrink fit interface between the outer peripheral surface of the arbor and the inner surface of the annular sleeve structure; said sleeve structure having internal passages for the flow of liquid coolant therethrough; ducts in the arbor in communication with the internal passages whereby, in use, liquid coolant flows through the ducts and the passages to form an annular thermal barrier in the sleeve structure; characterised in that the sleeve structure comprises either a single annular sleeve or inner and outer sleeves joined together without a shrink fit interface between them.

The sleeve structure may be provided with a plurality of internal passages each extending parallel to the longitudinal axis of the arbor. These passages may be formed by boring holes along the axis of the sleeve.

Alternatively, there may be a plurality of internal passages extending around the sleeve structure and coaxial with the periphery thereof.

In order to absorb as much heat as possible from the molten material, it is necessary for the part of the roll which contacts the molten material to be of a high conductivity metal, such as steel, copper, or any of their alloys.

The surface of the high conductivity metal may be covered with a protective surface layer, which for example could be a stainless steel with good thermal fatigue properties or a nickel or nickel/chrome layer or a metal matrix composite layer such as tungsten carbide/cobalt alloy or chrome carbide/nickel-chrome composite.

At the end of its useful life the sleeve structure may be removed from the arbor by externally heating to expand the sleeve structure whilst omitting all cooling.

The sleeve structure could then be refurbished prior to re-assembly.

The sleeve structure serves as the roll barrel and, since an external force can be exerted upon it, there has to be a shrink fit between the sleeve and the arbor to prevent it rotating around the arbor.

In use, care has to be taken that the temperature of the sleeve structure relative to that of the arbor is not such that will cause differential expansion between the arbor and the sleeve structure so as to remove the interface joint between them. By arranging for a thermal barrier to be located between the outer surface of the sleeve structure and the interface between sleeve structure and the arbor, a limited minimum amount of the heat applied to the outer surface of the sleeve structure penetrates to the interface between the sleeve and the arbor. At the same time, the liquid cooled sleeve structure efficiently removes heat from the outer surface of the sleeve structure thereby permitting rapid cooling of the material which is in contact with it.

The interference fit between the sleeve structure and the arbor provides a tensile stress in the sleeve structure which helps Go negate the thermally induced compressive stresses.

BRIEF DESCRIPTION OF THE DRAWINGS

In order that the invention may be more readily understood, it will now be described, by way of example only, with reference to the accompany drawings, in which.

DESCRIPTION OF THE PREFERRED EMBODIMENTS

Figure 1:
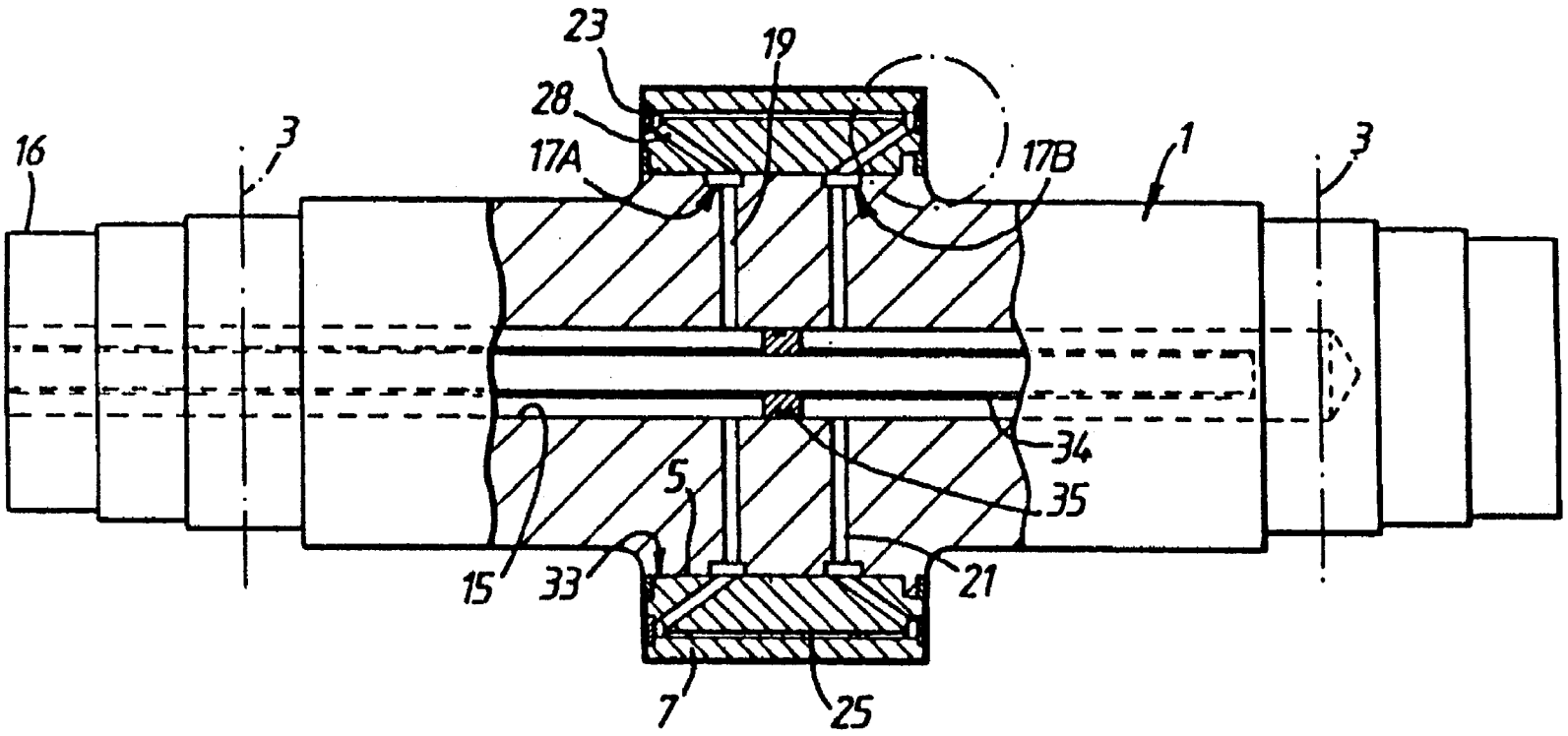
FIG. 1 is a view, partly in section, of a cooling roll in accordance with the present invention.

A roll suitable for use in a metal caster comprises an elongate arbor 1 having cylindrical portions 3 adjacent each end far receiving bearing assemblies (not shown). Substantially at the centre of the arbor there is a cylindrical surface 5 on to which an annular copper-alloy sleeve structure 7 is shrunk. At one end of the surface 5 there is an annular rib 9 which is integral with the arbor. An annular recess 10 is formed in the adjacent end wall 7 of the sleeve and a plurality of fitted bolts (not shown) extend through the rib into the sleeve 7 to provide additional securement for the sleeve on to the arbor. The recess 10 is closed off by an annular ring 12 which is secured to the rib 9 by a plurality of bolts 13.

An axial bore 15 extends into the arbor 1 from the non-drive end 16. A pair of annular channels 17A, 17B are formed in the surface 5 of the arbor beneath the sleeve 7. A plurality of radial bores 19 extend from the channel 17A to the bore 15 and, similarly, a plurality of radial bores 21 extend from the channel 17B to the bore 15. In the end wall of the sleeve 7, there is an annular channel 22 and a similar channel 23 is formed in the end wall of the opposite end of the sleeve. The two channels 22, 23 are connected by a multiplicity of passages 25 which extend between them in a direction substantially parallel to the longitudinal axis of the arbor 1. The passages 25 are spaced apart around the entire annular sleeve. In addition, the channel 22 is connected to the channel 17B by a bore 27 within the sleeve and, similarly, the channel 23 is connected to the channel 17A by an internal bore 28. The channels 22, 23 are closed off by cover plates 29 which may be of the same material as the sleeve 7 and fixed in position by any convenient means such as welding along lines 30.

A tube 34 with a central enlarged outer diameter and seal 37 is located within bore 15 and provides a barrier between two annular areas 17A and 17B one of which communicates with radial bores 19 and the other communicates with radial bores 21 for the passage of outgoing and incoming liquid coolant.

In use, liquid coolant, usually water, is passed along the space between the tube 34 and the bore 15 and into each of the bores 19 where it flows to the channel 17A at the interface between the sleeve and the arbor. The water then flows along the bore 28 to the channel 23 extending around the adjacent end face of the sleeve.

From this channel, the water flows through the multiplicity of passages 25 to the channel 22 in the end wall 22 of the sleeve.

The water flowing through the passageways 25 cools the adjacent parts of the sleeve and, consequently, a cooled zone extends around the sleeve in the vicinity of the passageways. This cooled zone serves as a barrier which reduces the flow of heat from the outer surface of the sleeve to the interface between the sleeve and the arbor, thus preventing the temperature of the sleeve in the vicinity of the interface with the arbor from rising to a level where the shrink fit interface between the sleeve and the arbor is destroyed. The cooled zone serves to cool the outer surface of the sleeve thereby causing metal to solidify in contact with the surface.

From the channel 22 the water flows along the bore 27 to the annular channel 17B and then via the bores 21 to the annulus formed by the pipe and bore 15 on the opposite side of the seal 37 and through the tube 34. The coolant may be made to flow in the reverse route to that described previously. A rotary coupling (not shown) is coupled to the end 16 of the arbor to permit coolant to circulate through the roll as the roll is rotated.

An annular seal 33 is located at each end of and between the sleeve and the arbor to prevent leakage of coolant from between the arbor and the sleeve. These seals can be fitted after assembly of the sleeve which will aid maintenance in the event of failure as well as negate the requirement to assemble the seals prior to the shrink fitting of the sleeve 7 on to the arbor 1.

The sleeve can have a hard facing layer 31 on its outer periphery. This layer may comprise of chrome on nickel or stainless steel or a metal matrix composite such as tungsten carbide/cobalt alloy or chrome carbide/nickelchrome composite. The barrel ends of sleeve 7 also can have similar hard facing layer 32.

Figure 3:
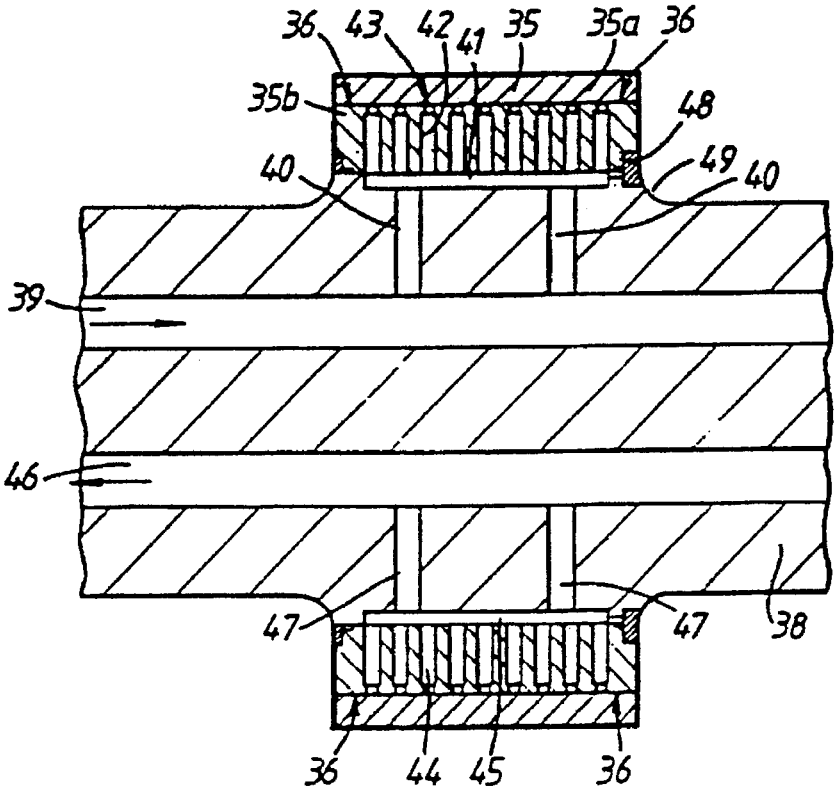
FIG. 3 shows a sectional view of an alternative cooling roll also, in accordance with the invention.

FIG. 3 shows sleeve structure 35 formed by welding or otherwise suitably joining together two separate sleeves 35*a*, 35*b* at joints 36. Coolant enters the arbor 38 along a hole 39 and then passes via radial bores 40 to a slot 41 at the shrink fit interface between the sleeve structure and the arbor.

From slot 41, the cooling water passes through a series of radial holes 42 to circumferential grooves 43 at the interface between the two sleeves where it splits into two directions to pass circumferentially around the sleeve structure until the two flows unite to exit by a second series of radial holes 44. The cooling water passes from radial holes 44 to a second slot 45 which is connected to the outlet hole 46 in the arbor 38 by radial bores 47.

Figure 2:
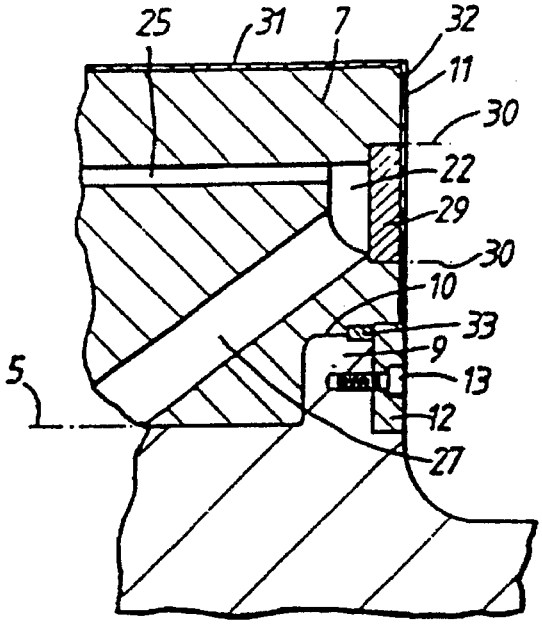
FIG. 2 shows to an enlarged scale the part of the roll within the broken lines of FIG. 1.

FIG. 3 also shows an alternative method of providing the rib 9 shown in FIGS. 1 and 2. The rib is formed by fixing a disc 48 to the arbor 38 with bolts 49.

We claim:

1. A cooling roll comprising:

a rotatable arbor;

an annular sleeve structure mounted on the arbor with a shrink fit interface between the outer peripheral surface of the arbor and the inner surface of the annular sleeve structure;

channels formed at the interface between the outer peripheral surface of the arbor and the inner surface of the annular sleeve structure;

said sleeve structure having at least one internal passage for the flow of liquid coolant, the at least one passage being positioned between the outer peripheral surface of the sleeve structure and said interface and being in communication with the channels;

said arbor having ducts therein which are in communication with the exterior of the roll and with said channels, said ducts, channels and the at least one passage being arranged such that, in use, liquid coolant flows between the exterior of the roll and the at least one passage by way of the channels and the ducts to form a thermal barrier in the sleeve structure which is located between the outer peripheral surface of the sleeve structure and the interface between the sleeve and the arbor.

2. A cooling roll as claimed in claim 1 wherein the sleeve structure has a plurality of passages extending parallel to the longitudinal axis of the arbor, opposite ends of the passages being connected to respective ones of a pair of channels at the interface.

3. A cooling roll as claimed in claim 1 wherein the periphery of the sleeve structure is protected by a thermally tough material which is harder than the sleeve structure.

4. A cooling roll as claimed in claim 1 in which the sleeve structure comprises inner and outer sleeves joined together.

5. A cooling roll as claimed in claim 4 wherein the sleeve structure comprises the outer annular sleeve mounted on and welded to the inner annular sleeve and the internal passages include circumferential grooves at the interface between the inner and outer sleeves.

* * * * *